US009823041B2

(12) United States Patent
Forslund

(10) Patent No.: US 9,823,041 B2
(45) Date of Patent: Nov. 21, 2017

(54) DEVICE AND METHOD FOR CONNECTING A CHEEK REST TO A RIFLE BUTT

(71) Applicants: David Henriksson, Kalix (SE); Magnus Lundbäck, Kalix (SE); Andreas Forslund, Kalix-Nyborg (SE)

(72) Inventor: Andreas Forslund, Kalix-Nyborg (SE)

(73) Assignee: Kalix Teknik AB, Kalix (SE)

( * ) Notice: Subject to any disclaimer, the term of this patent is extended or adjusted under 35 U.S.C. 154(b) by 0 days.

(21) Appl. No.: 14/917,092

(22) PCT Filed: Sep. 3, 2014

(86) PCT No.: PCT/SE2014/000110
§ 371 (c)(1),
(2) Date: Mar. 7, 2016

(87) PCT Pub. No.: WO2015/034410
PCT Pub. Date: Mar. 12, 2015

(65) Prior Publication Data

US 2016/0216060 A1 Jul. 28, 2016

(30) Foreign Application Priority Data

Sep. 6, 2013 (SE) ..... 1300585

(51) Int. Cl.
*F41C 23/14* (2006.01)
*F41C 23/22* (2006.01)

(52) U.S. Cl.
CPC ..... *F41C 23/14* (2013.01); *F41C 23/22* (2013.01)

(58) Field of Classification Search
CPC ..... F41C 23/08; F41C 23/14; F41C 23/00
(Continued)

(56) References Cited

U.S. PATENT DOCUMENTS 737,732 A 9/1903 Gaut
3,710,496 A * 1/1973 Packmayr ..... F41C 23/14 42/71.01

(Continued)

FOREIGN PATENT DOCUMENTS

GB 951030 A 3/1964

OTHER PUBLICATIONS

International Search Report PCT/ISA/210 for International Application No. PCT/SE2014/000110 dated Dec. 1, 2014.

(Continued)

*Primary Examiner* — Stephen Johnson
(74) *Attorney, Agent, or Firm* — Harness, Dickey, & Pierce, P.L.C.

(57) ABSTRACT

Connection device (1) for connecting a cheek rest (2) to rifle stock (3) with at least one internal space (4), whose cheek rest (2) includes at least one first connection bracket (7) and at least one second connection bracket (9) with which the cheek rest (2) may be adjustably connected to at least one bracket which during use is inserted into the internal space of a rifle stock. The bracket is comprised of a locking block (10) which when connecting the cheek rest (2) to the rifle stock (3) is inserted into the internal space (4) and positioned in relation to the inside of the internal space and through holes drilled in the rifle stock's top side and side, and that the cheek rest's connection brackets are temporarily connected to at least one bracket in the locking block (10) by said holes in the stock's top side. The present invention also encompasses a method for utilizing the device.

12 Claims, 14 Drawing Sheets

(58) Field of Classification Search
USPC ..... 42/73, 74
See application file for complete search history.

(56) References Cited

U.S. PATENT DOCUMENTS

| | | | | |
|---|---|---|---|---|
| 4,896,446 | A | 1/1990 | Gregory | |
| 5,235,764 | A | 8/1993 | Perazzi | |
| 5,970,642 | A | 10/1999 | Martin | |
| 6,457,273 | B2 * | 10/2002 | Gussalli Beretta | F41C 23/14 42/73 |

OTHER PUBLICATIONS

Written Opinion of the International Searching Authority PCT/ISA/237 for International Application No. PCT/SE2014/000110 dated Dec. 1, 2014.

* cited by examiner

DEVICE AND METHOD FOR CONNECTING A CHEEK REST TO A RIFLE BUTT

CROSS-REFERENCE TO RELATED APPLICATIONS

This application is a national phase under 35 U.S.C. §371 of PCT International Application No. PCT/SE2014/000110 which has an International filing date of Sep. 3, 2014, which claims priority to Swedish Application No. 1300585-5, filed Sep. 6, 2013, the entire contents of each of which are hereby incorporated by reference.

FIELD OF THE INVENTION

The present invention concerns a connection device, for a cheek rest to a rifle stock or similar, in accordance with the claims.

BACKGROUND OF THE INVENTION

A large number of different types of firearms have been developed through the years. For example, rifles and the like have been developed which include elongated stocks whose butt end rests against the rifleman's shoulder during firing. The stocks are of different designs and they are made of different materials. Traditionally stocks have been made of wood. In more recent times, stocks have been developed which are made of or include composite materials, polymer materials and the like.

One type of problem that arises in conjunction with the use of rifles occurs when the stock is positioned against the rifleman's shoulder resulting in the creation of an intermediate space between the user's cheek and the stock. This is an especially palpable problem when using riflescopes and similar sighting devices (other than open sights). The rifleman may perceive this as being annoying and/or it may also affect precision during shooting.

Several devices such as cheek rests (pieces) and the like, which connect to the rifle stock, have been developed in order to minimize the inconvenience of the above mentioned problem. The connection of a cheek rest to a firearm, especially post-production, usually results in a substantial alteration of the rifle stock. Mounting cheek rests on existing stocks is also expensive and time consuming.

Known types of cheek rests have primarily been developed for connection to wooden rifle stocks. Wooden stocks allow for certain designs of cheek rests and methods for connecting them to rifle stocks. Because of the development of stocks that include at least one internal space, new problems have arisen when connecting known types of cheek rests and the like to rifle stocks. It is for example not possible to connect known types of cheek rests to composite stocks with internal spaces without problems.

In regard to the fact that there currently exist a great number of sold rifles with composite stocks, where owners desire the connection of cheek rests to these rifle stocks, there exists a need for better connection devices for cheek rests.

Another problem with cheek rests is the creation of a connection bracket which can fit several different models of rifle stocks. Among other things, the dimensions of the internal spaces vary which gives rise to problems when connecting a cheek rests to these types of stock designs.

Certain types of existing rifle stocks may include an internal space that is divided by at least one intermediate partition, as shown in FIG. 2B, which stretches along part or all of the internal space. The intermediate partition divides the internal space into at least one first internal space and at least one second internal space. The fact that a rifle stock may include an internal space that includes an intermediate partition or not may cause problems.

Despite the fact that existing designs partially fill their stated purposes, there still exist several different problems with these designs.

PRIOR ART

One example of these types of designs is a design shown and described in U.S. Pat. No. 737,732. It describes an adjustable cheek rest which is intended to be connected to a rifle stock. This design differs to a significant extent from the design in accordance with the present patent application.

Another example of these types of designs is a design described in U.S. Pat. No. 4,896,446 that is a variant of an adjustable cheek rest for rifles. A unique feature of this design according to its description, is that the cheek rest is recoil dampened in relation to the rifle stock. This design differs from the present invention. For example, it does not include a connection bracket which is intended to be used in an internal space.

Yet another example of known designs consists of a design which is described in U.S. Pat. No. 5,235,764 that describes a variant of a cheek rest which is arranged to be adjustable in both the vertical and lateral direction. This design differs to a significant extent from the design in accordance with the present patent application. For example, it does not include a connection bracket which is intended to be used in an internal space.

A variant of an ergonomic rifle stock that includes an adjustable cheek rest is described in U.S. Pat. No. 5,970,642. This design according to its description differs to a significant extent from the design in accordance with the present patent application. For example, the design according to its description does not include a corresponding connection device with which the cheek rest is connected to the rifle stock.

PURPOSE OF THE INVENTION

The main purpose of the present invention is to create an improved connection device for rifle stock cheek rests which solves or minimizes at least one of the above mentioned problems. This purpose is accomplished with a device in accordance with the claims.

BRIEF DESCRIPTION OF THE DRAWINGS

In the following detailed description, the present invention will be more closely described with reference to the accompanying drawings which in exemplifying purpose show the present preferred embodiments of the invention.

DETAILED DESCRIPTION OF THE INVENTION

Figure 1A:
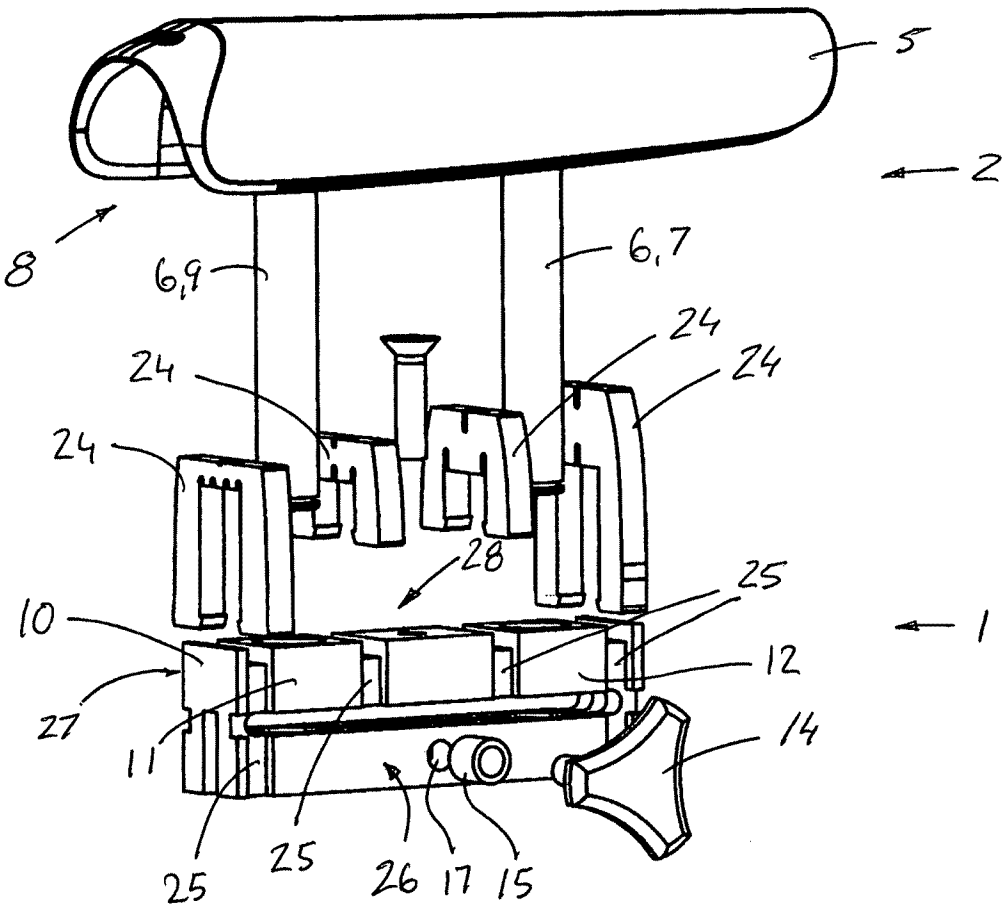
FIGS. 1A, 1*b*, and 1*c* illustrate a first embodiment of the invention connected to a rifle stock.
Figure 1B:
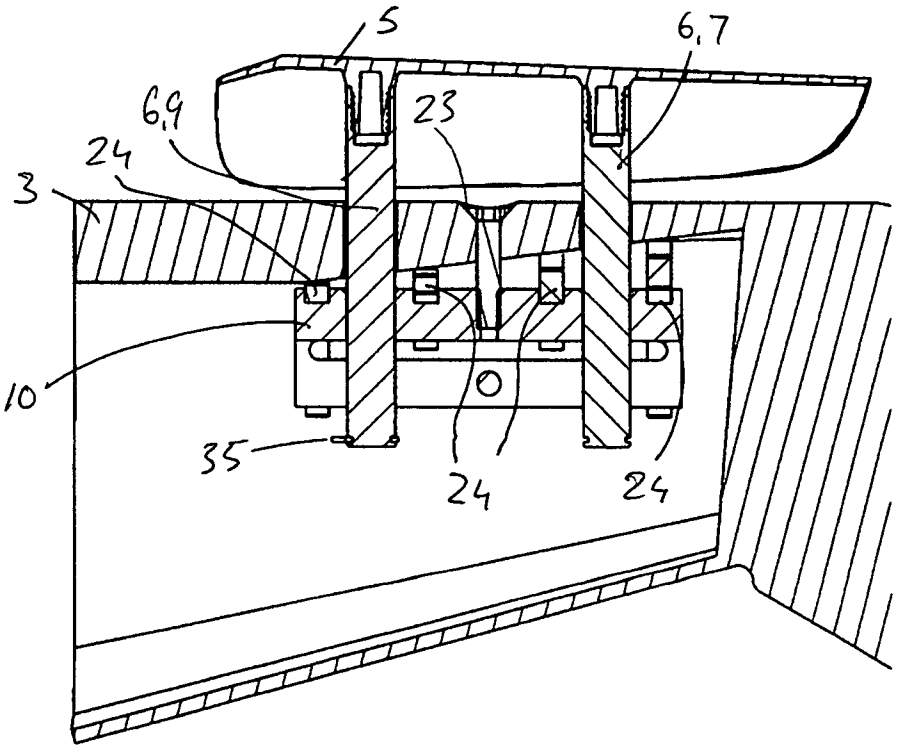
Figure 1C:
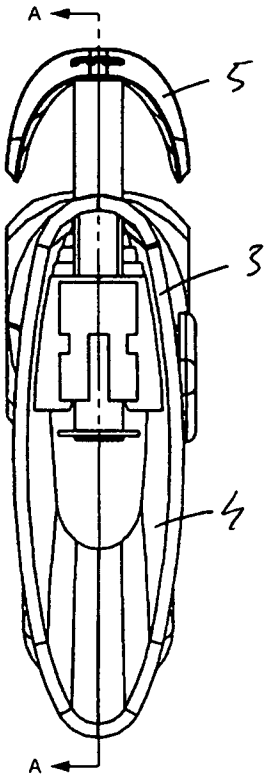

With reference to the figures is shown a connection device 1 with which at least one cheek rest 2 is connected to a rifle stock 3 or similar which includes at least one internal space 4 in accordance with the present patent application. Preferably, the connection device 1 is intended to be connected to a rifle stock 3 with at least one internal space 4, which is made of composite material or another for the purpose suitable material or combinations of material.

The form (shape) and design of the cheek rest 2 may vary within the scope of the present invention concept. In the exemplifying embodiment, the cheek rest includes at least one support part (support rest) 5 against the cheek and at least one bracket (connector) 6 with which the cheek rest is connected to the rifle stock or similar.

The cheek rest's bracket 6 consists of at least one connection bracket 7 or similar which stretches out a bit from the underside 8 of the cheek rest's support part 5. In the exemplifying embodiment, the cheek rest 2 consists of at least one first connection bracket 7 and at least one second connection bracket 9 which stretches out a bit from the underside of the support part 5. The connection brackets 7 and 9 in the exemplifying embodiment are of round bars, profiled section bars or similar. In alternative embodiments the connection brackets may be of another for the purpose suitable design and form.

The connection device 1 includes at least one locking block (mount, bracket) 10 which is intended to be inserted into the internal space of the rifle stock and positioned in the upper section of the internal space. In a first embodiment, whole or part of the locking block's 10 contact surface against the partitions in the internal space has a corresponding or essentially corresponding shape as the surface or surfaces that it rests against in the internal space of the stock. The locking block 10 includes at least one first attachment element 11 for at least one connection bracket 7. In the exemplifying embodiment, the connection bracket 9 includes at least one first element 11 for the first connection bracket 7 and at least one second attachment element 12 for the second connection bracket 9. Further, the design includes at least one positioning device (locking device) 13 with which the relative positions between the first element and the connection bracket are temporarily fixed to and released from one another (allows for the adjustment of the cheek rest). The design also includes at least one adjusting knob 14 and at least one spacing sleeve 15. These are inserted through a hole 16 in the side of the stock. Preferably, the adjusting knob 14 consists of at least one threaded part (rod) which is intended to be inserted into a threaded hole 17 in the locking block.

Figure 2A:
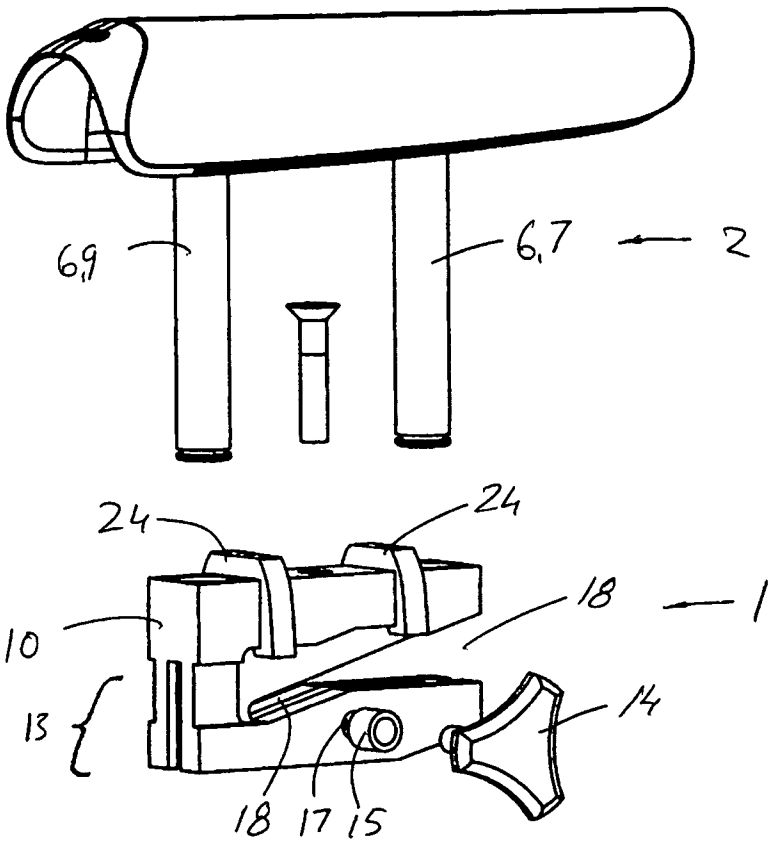
FIGS. 2A, 2*b*, and 2*c* illustrate a second embodiment of the invention.
Figure 3A:
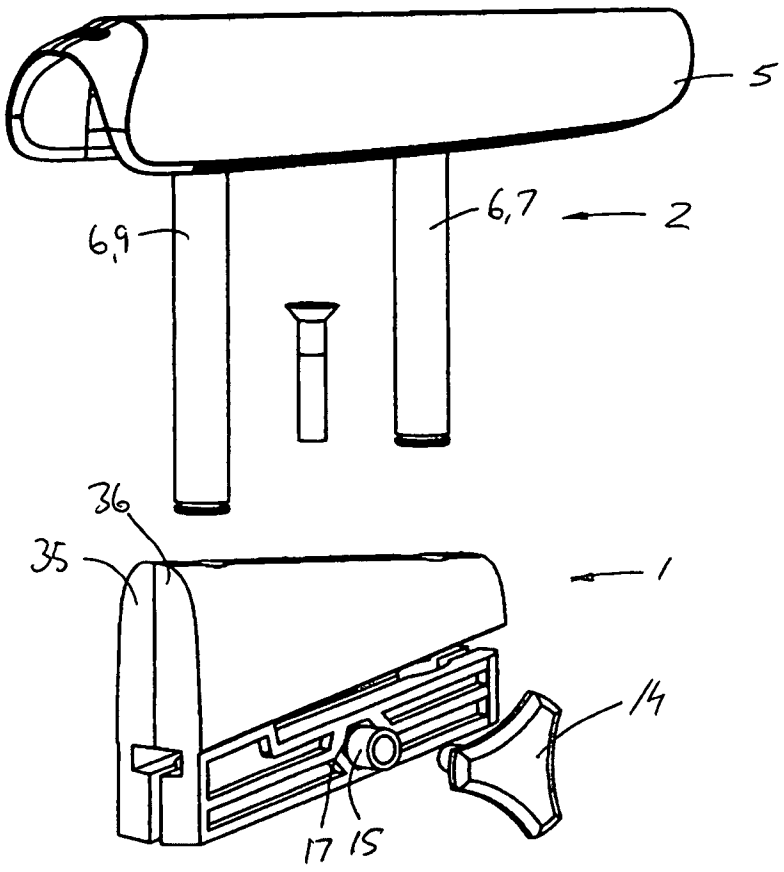
FIGS. 3A, 3*c*, 3*c*, and 3*d* illustrate a third embodiment of the invention as connected to a rifle stock.
Figures 3B, 3C, 3D:
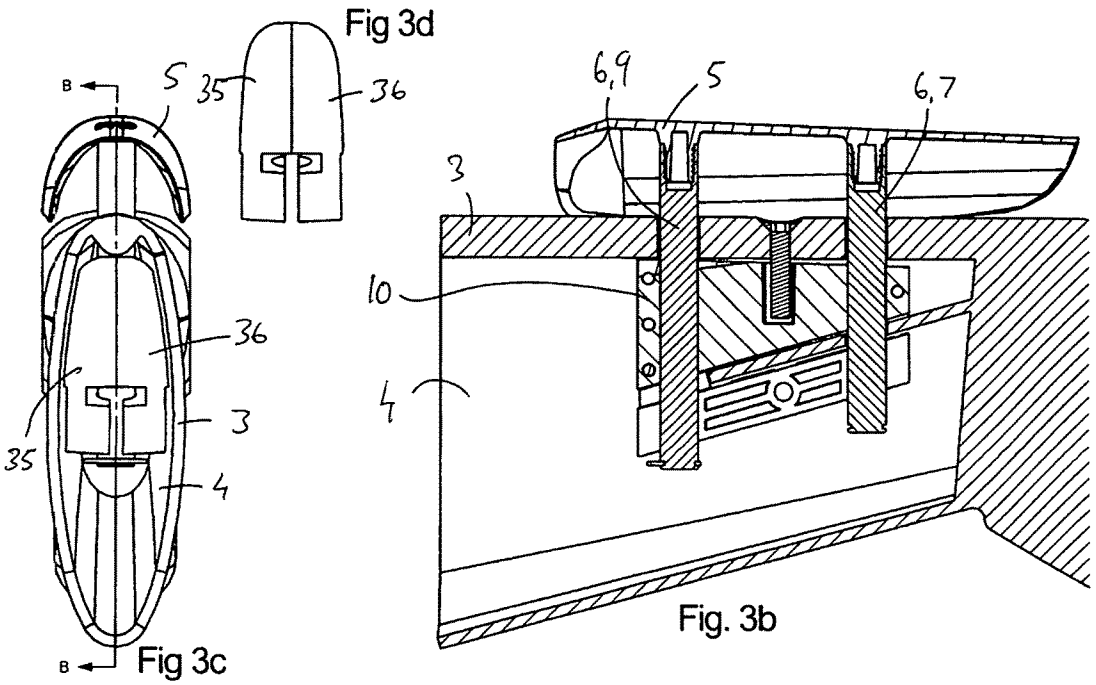

With reference to FIG. 2A and 3A is shown an alternative embodiment of the invention where the locking block includes at least one groove 18, track, recess or similar in which a partition 19, material layer or similar in the internal space is intended to be inserted when the locking block is connected to the stock.

The locking block also includes at least one first attachment element 21 which in the exemplifying embodiment consists of threaded hole 22 that is placed on the top side of the locking block 10. Through a hole 23 in the top side of the stock, a second attachment element such as screw or similar is intended to be inserted into and screwed into the first attachment element 21.

In the exemplifying embodiment shown in FIG. 1A-1C and 2A-2C, the device 1 includes at least one adjusting block (gauge block) 24 with which an adjustment of the form of the locking block's 10 contact surface against the internal space's contact surface may occur. In the exemplifying embodiment the adjusting block 24 is connected to the locking block 10 via at least one groove 25 in the locking block. The groove 25 stretches along whole or part of side 26, side 27 and the top side 28 of the locking block 10. Alternatively, the adjusting block 24, alternatively the adjusting blocks 24, may be connected to the locking block 10 by another for the purpose suitable technology. The adjusting block (adjusting blocks) 24 is preferably exchangeable which allows for an adjustment of the locking block's 10 contact surface against the partitions in the internal space without the entire locking block having to be replaced.

In the exemplifying embodiment the device 1 includes at least one first adjusting block 24 and at least one second adjusting block 24 such as for example shown in FIG. 1A and 2A. In further exemplifying embodiments, the number of adjusting blocks 24 may be three or more such as in the exemplifying embodiment shown in FIG. 1 where the number of adjusting blocks is four. The adjusting blocks may be of different sizes, shapes, forms, etc.

Figure 4:
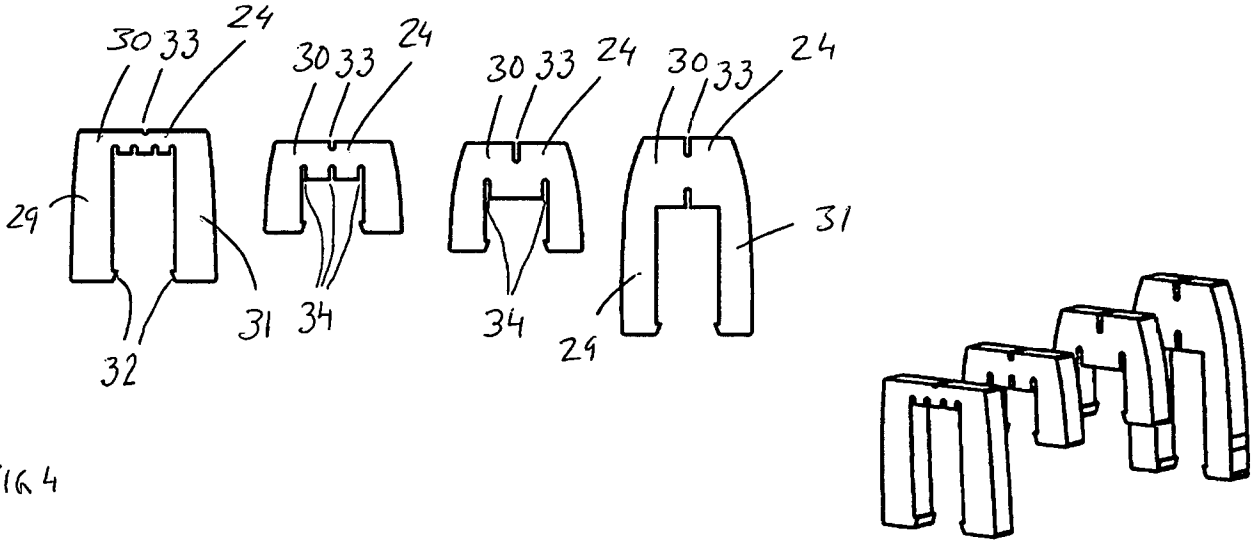
FIG. 4 shows variants of adjusting blocks or alternatively gauge blocks.

With reference to FIG. 4 is shown exemplifying embodiments of the adjusting block 24 which consists of at least one first part 29 which transitions into a second part 30 which transitions into a third part 31 which together form a shape that likens a U. In alternative embodiments the adjusting blocks' 24 design may be of another for the purpose suitable shape. The shape and size of the adjusting blocks may vary within the scope of the present patent application.

In the exemplifying embodiment the adjusting block includes at least one locking element 32 with which the adjusting block essentially is hindered from unintentional release from the locking block after it has been connected to the locking block. In the exemplifying embodiment exists a groove 33, recess or the like on the outside of the adjusting block's second part 30 (intermediate part). In the exemplifying embodiment also exists recesses 34 on the inside of the adjusting block's second part 30 (intermediate part).

With reference to FIGS. 3*a*, 3*b*, 3*c*, and 3*d* is shown a locking block 10 which is divisible, alternatively fabricated of two halves. The locking block 10 may even consist of at least two or more parts. In the exemplifying embodiment the adjusting block 10 includes a first part 35 and at least one second part 36.

In the embodiment according to FIGS. 3*a*, 3*b*, 3*c*, and 3*d*, the locking block 10 is designed to correspond to one size (or a few) of the forms of the internal space.

METHOD FOR THE UTILIZATION OF THE DEVICE

The present invention also includes a method for connecting the cheek rest to a rifle stock that includes at least one internal space in the stock. If the butt end is connected to the stock, it is first removed from the stock.

Figure 5:
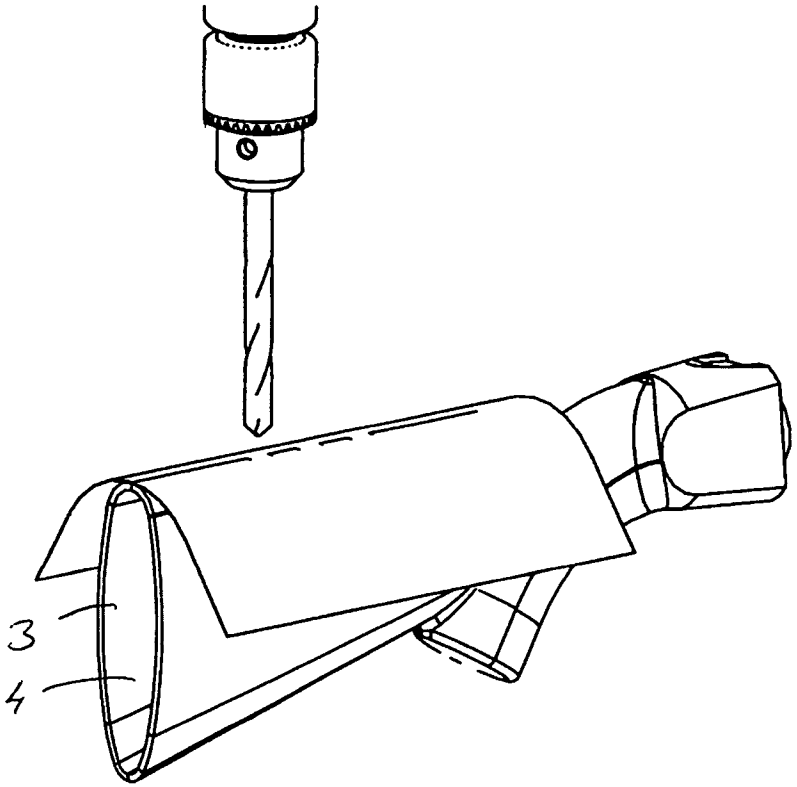
FIGS. 5, 6, 7, 8, 9, 10 and 11 illustrate a method of utilizing the various embodiments in accordance with the present patent application.
Figure 6:
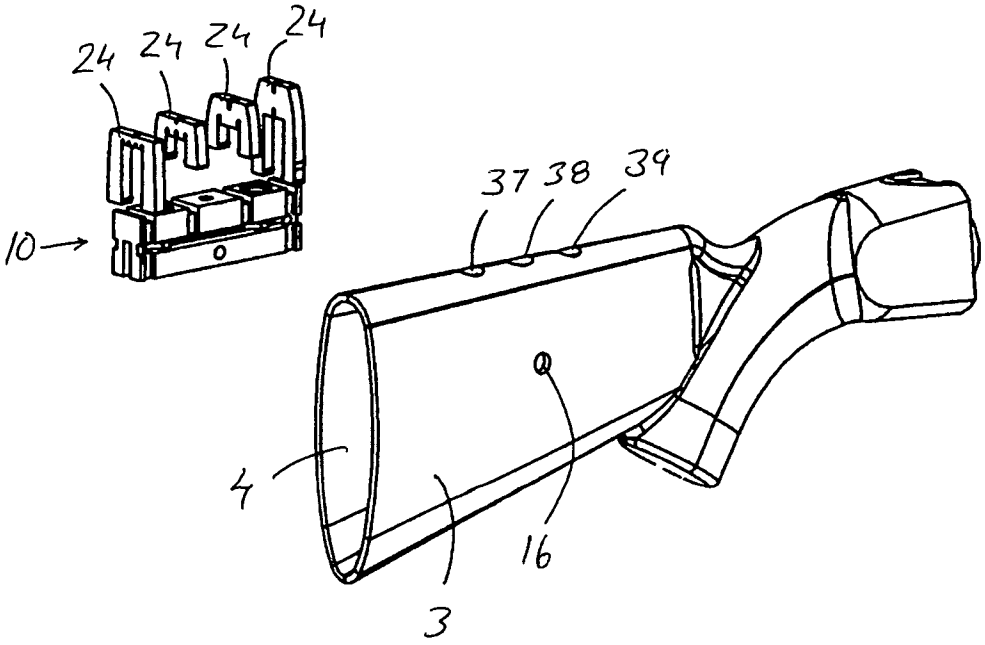

With reference to FIGS. 4 and 5 is shown that at least one first hole, at least one second hole and at least one third hole are realized (drilled) from the top side of the rifle stock in toward the internal space of the stock. The position of the holes may be measured out with a suitable measuring instrument. In the exemplifying embodiment in the figure, the measuring of the holes' positions is accomplished with the aid of a template. After the holes' positions are marked, the holes are made by drilling or by another for the purpose suitable technique. Drilling may occur by two or more drill bits with incremental larger diameters being used during the drilling of the holes. This allows for a greater precision in making the holes.

At least one hole is thereafter drilled from the rifle stock's side in into the internal space. This hole is drilled for the adjusting screw. With adjusting screw means a screw with which locking and unlocking of the cheek rest may occur (adjustment of the height of the cheek rest in relation to the stock).

With reference to FIG. 2A is shown how a locking block in a first embodiment has a fixed size. When using fixed size locking blocks, a locking block 10 is chosen whose form is in relation to the form of the internal space. The first embodiment has thus the disadvantage that a specific locking block 10 for each type of stock must be used because the shape of the internal space varies.

Figure 2B:
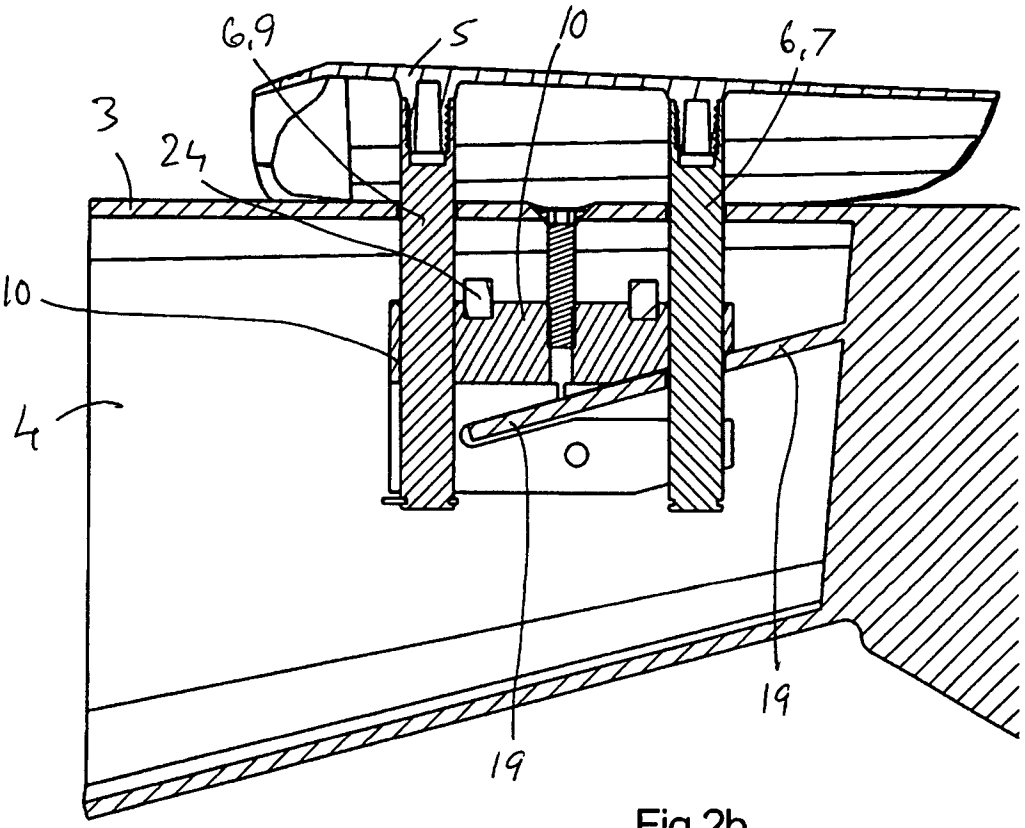
Figure 2C:
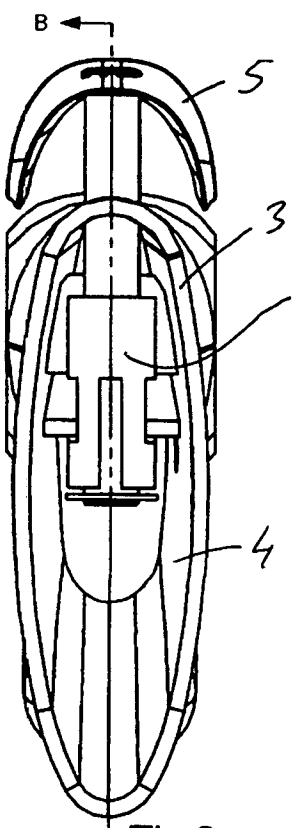

With reference to FIG. 2B and 2C is shown that in the alternative embodiments, where the device includes at least one adjusting block which fits against the contact surface in the internal space in the stock, the adjusting block is connected to the locking block. In cases where two or more adjusting blocks are used, they are connected to the locking block.

Figure 7:
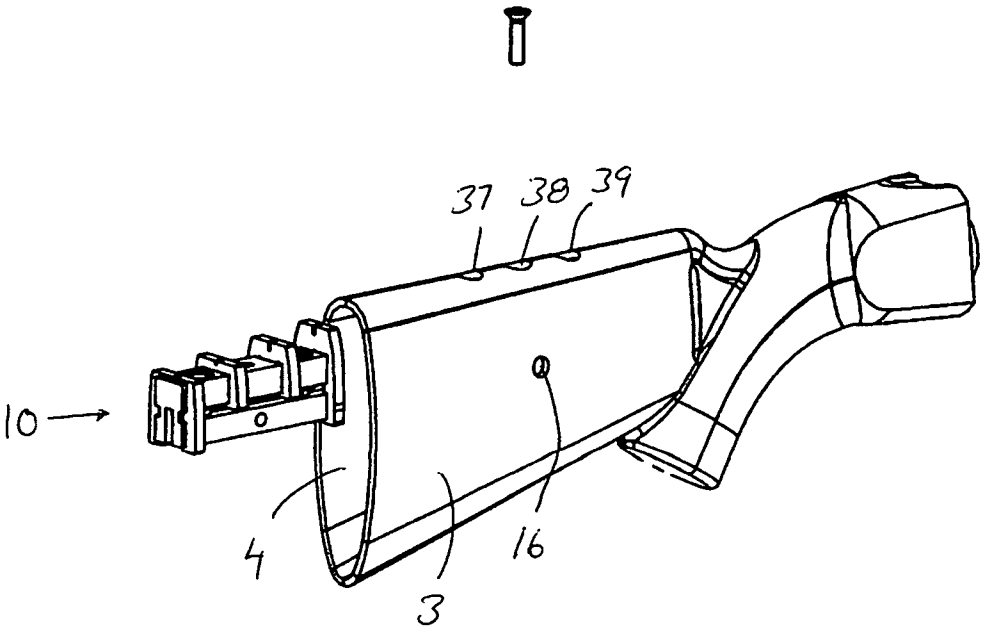
Figure 8:
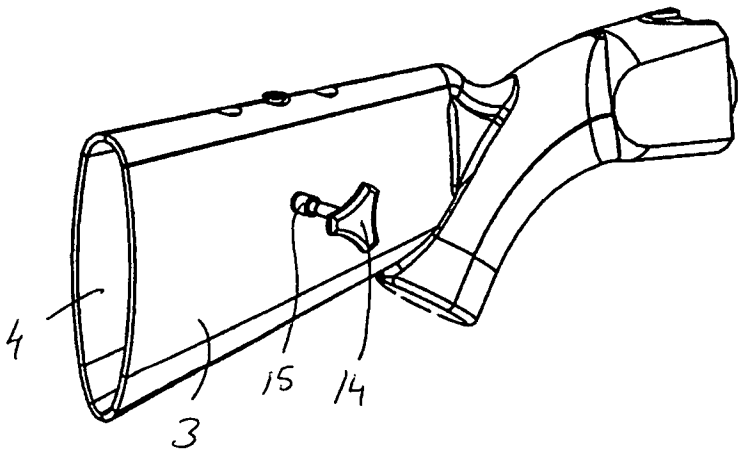

With reference to FIGS. 7 and 8 is shown that after a suitable shape of locking block 10 is chosen, or suitable adjusting blocks 24 to the locking blocks 10 are chosen and connected to the locking block 10, the locking block 10 is inserted into the internal space 4 and connected to the stock with at least one screw or other suitable fastener. The screw is screwed down through a drilled hole in the stock's top side and in into a threaded hole in the locking block's top side. Preferably, the hole for the fastening screw is drilled between the holes for the cheek rest's brackets. The screw may preferably be of a countersunk type.

After that the spacing sleeve and the adjusting knob are inserted in through the hole in the stock's side and connected to a threaded hole (or other suitable technique) in the locking block's side. The adjusting knob's screw is screwed loosely into the threaded hole in the locking block so as not to block the brackets of the cheek rest from being freely inserted into the holes in the locking block.

Figure 9:
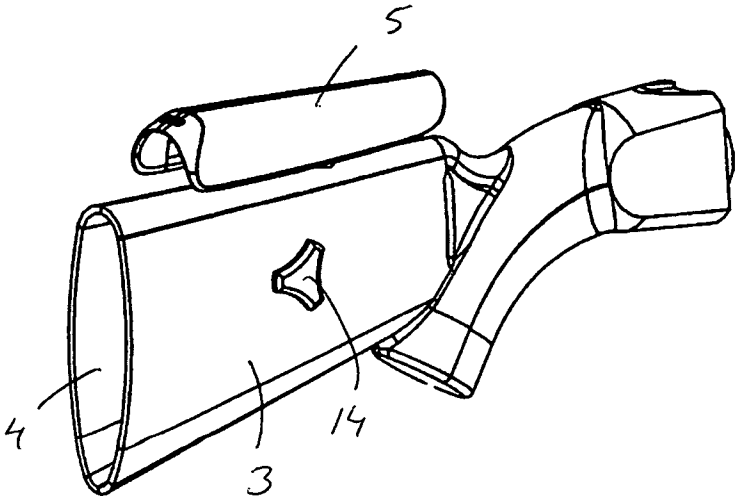

With reference to FIG. 9 is shown that after the cheek rest's connection brackets 7 and 9 are inserted down into the holes (alternatively the hole) in the rifle stock's top side they go into the holes (alternatively the hole) in the locking block. When a suitable height (position) for the cheek rest in relation to the stock is chosen, the cheek rest's connection brackets 7 and 9 are fixed (locked) to the locking block. Preferably, this locking occurs by clamping, which for example is accomplished by the locking block including at least one first part and at least one second part which may be brought toward each other with the adjusting screw (or with another for the purpose suitable technique).

Figure 10:
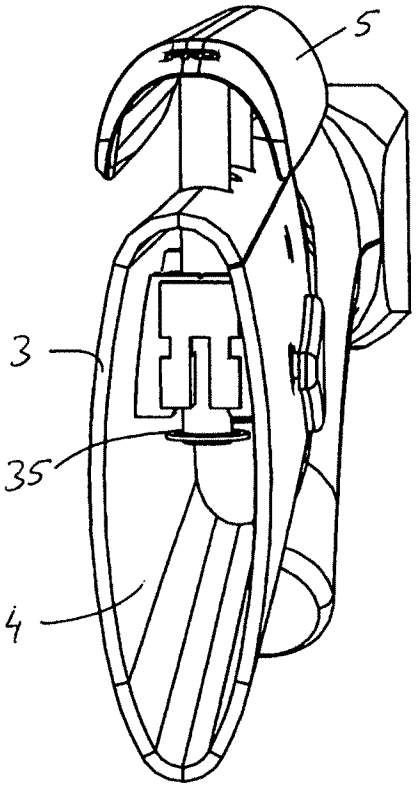

With reference to FIG. 10 is shown how at least one locking element 35, such as a clasp, clip, locking ring or similar, is preferably connected to at least one of connection brackets' 7 and 9 ends or in the vicinity of the ends. The locking elements are for preventing the bracket from unintentionally loosening from the locking block.

Figure 11:
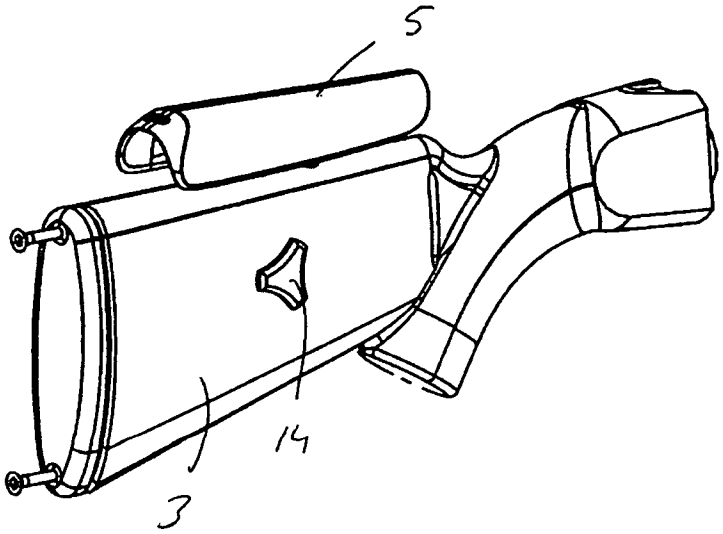

With reference to FIG. 11 is shown how the rifle butt is connected to the butt end of the stock.

When necessary the cheek rest's distance from the top edge of the stock may be adjusted by the adjusting screw being loosened and that the connection brackets' 7 and 9 position in relation to the locking block is adjusted accordingly after which the adjusting screw is tightened.

In the detailed description of the present invention, design details or parts of the method may have been omitted which are apparent to persons skilled in the art of the field of the device and method. Such obvious design details and parts of the method are included to the extent necessary so that the proper and full performance of the present invention is achieved.

Even if certain preferred embodiments of the device and method have been described in detail, variations and modifications within the scope of the invention may become apparent for specialists in the field of the invention.

ADVANTAGES OF THE INVENTION

Several advantages are achieved by the present invention. The most important advantage is that at least one of the above mentioned disadvantages are eliminated or minimized.

The invention claimed is:

1. A connection device for connecting a cheek rest to a rifle stock having at least one internal space, the connection device comprises:

a first connection bracket and a second connection bracket;

a locking block that includes a first attachment element and a second attachment element the locking block is configured to be inserted into the rifle stock's internal space, the first attachment element and the second attachment element are configured to connect with the first connection bracket and the second connection bracket, respectively, by means of a first hole and a second hole in a top side of the rifle stock, respectively; and an adjusting screw inserted through a hole in a side of the rifle stock, the adjusting screw configured to lock the first connection bracket and the second connection bracket to the first attachment element and the second attachment element respectively so that a height of the cheek rest in relation to the rifle stock is fixed, when the adjusting screw is turned in a first direction, and release the first and second connection brackets so that the height of the cheek rest in relation to the rifle stock is adjustable, when the adjusting screw is turned in a second direction.

2. The connection device in accordance with claim 1, wherein the locking block is adjusted to be positioned in an upper section of the internal space of the rifle stock, and the locking block includes a contact surface with a corresponding shape, or substantially corresponding shape to an internal contact surface of the rifle stock the locking block is configured to rest against the internal contact surface in the internal space of the rifle stock.

3. The connection device in accordance with claim 1, at least one adjusting block which is adjusted to fit against an internal contact surface of the rifle stock in the internal space of the rifle stock, the adjusting block is connected to the locking block.

4. The connection device in accordance with claim 3, wherein the adjusting block has a shape corresponding to a shape of an upper section of the internal space of the rifle stock.

5. The connection device in accordance with claim 1, further comprising at least one adjusting block connected to the locking block, the adjusting block is exchangeable.

6. The connection device in accordance with claim 1, comprising at least one adjusting block connected to at least one groove in the locking block.

7. The connection device in accordance with claim 1, wherein the locking block comprises at least one groove configured to receive an intermediate partition in the internal space of the rifle stock.

8. The connection device in accordance with claim 1, further comprising an adjusting block including a first part, a second part and a third part, wherein the first part transitions into the second part, and the second part transitions into the third part and the first part, the second part, and the third part together form a shape that likens a U.

9. The connection device according to claim 1, wherein the rifle stock is made of a composite material.

10. A method for attaching a cheek rest to a rifle stock, the rifle stock having an internal space, the method comprising:

realizing a first hole, a second hole and a third hole from a top side of the rifle stock into the internal space of the rifle stock;

realizing a fourth hole from a side of the rifle stock in to the internal space;

choosing at least one locking block whose contact surface's form fits against an inside of the internal space in the rifle stock;

inserting the at least one locking block into the internal space via a rear opening of the rifle stock;

connecting the locking block to a top side of the rifle stock via a screw which is screwed down through the third hole;

inserting first and second connection brackets down through the first and second holes realized in the top side of the rifle stock, respectively, and into a first attachment element and a second attachment element in the locking block, respectively;

connecting at least one spacing sleeve and an adjusting screw to the locking block by the fourth hole;

achieving a desired position of the cheek rest in relation to the top side of the rifle stock; and locking the first and second brackets in relation to the locking block with the adjusting screw.

11. The method in accordance with claim 10, further comprising connecting at least one adjusting block against a contact surface in the internal space in the rifle stock, before the inserting the locking block into the internal space.

12. The method in accordance with claim 11, further comprising connecting the first connection bracket and the second connection bracket to the locking block before the inserting the locking block into the internal space.

* * * * *